United States Patent [19]

Druesne et al.

[11] Patent Number: 5,012,942

[45] Date of Patent: May 7, 1991

[54] EASILY CUT ALUMINIUM CLOSURE CAPSULE

[75] Inventors: Guy Druesne, St. Seurin sur l'Isle; Joël Michaud, Montpon Menestrol, both of France

[73] Assignee: Cebal, Clichy, France

[21] Appl. No.: 393,257

[22] Filed: Aug. 14, 1989

[30] Foreign Application Priority Data

Sep. 7, 1988 [FR] France ..... 88 12059

[51] Int. Cl.[5] ..... B65D 41/00

[52] U.S. Cl. ..... 215/253; 215/326

[58] Field of Search ..... 215/253, 324, 326, 328, 215/246

[56] References Cited

U.S. PATENT DOCUMENTS

| | | | |
|---|---|---|---|
| 2,063,615 | 12/1936 | Merolle | 215/324 X |
| 2,444,506 | 7/1948 | Hammer | 215/253 X |
| 2,854,003 | 9/1958 | Kirsch | 215/253 X |
| 3,810,556 | 5/1974 | Coursaut | 215/215 X |
| 4,105,133 | 8/1978 | La Barge et al. | 215/253 X |
| 4,114,775 | 9/1978 | Shinozaki | 215/324 |
| 4,217,989 | 8/1980 | George | 215/253 |
| 4,294,367 | 10/1981 | Otsuka et al. | 215/253 X |

FOREIGN PATENT DOCUMENTS

| | | | |
|---|---|---|---|
| 1136579 | 11/1982 | Canada . | |
| 2230330 | 3/1973 | Fed. Rep. of Germany | 215/253 |
| 2723115 | 12/1978 | Fed. Rep. of Germany | 215/324 |
| 1050150 | 1/1954 | France | 215/253 |
| 2330603 | 6/1977 | France . | |
| 502847 | 3/1939 | United Kingdom . | |
| 780379 | 7/1957 | United Kingdom | 215/246 |
| 1440589 | 6/1976 | United Kingdom | 215/326 |

*Primary Examiner*—Stephen Marcus
*Assistant Examiner*—Nova Stucker
*Attorney, Agent, or Firm*—Dennison, Meserole, Pollack & Scheiner

[57] ABSTRACT

The object of the invention is an aluminium or an alloy closure capsule adapted to be crimped onto the neck of a bottle and of which the ring comprises a shoulder, the skirt of this capsule comprising a retaining ring or peripheral rib which, after the capsule has been crimped onto the neck, will define with the portion of the skirt covering the top edge of the said shoulder of the neck an annular groove permitting guidance of a blade for cutting the capsule, and also a line of weakness consisting of a thinned peripheral zone situated in the bottom of the said groove. The invention also relates to the method of producing this capsule which is used for any closure of a bottle which has to have its capsule removed by means of a knife.

7 Claims, 3 Drawing Sheets

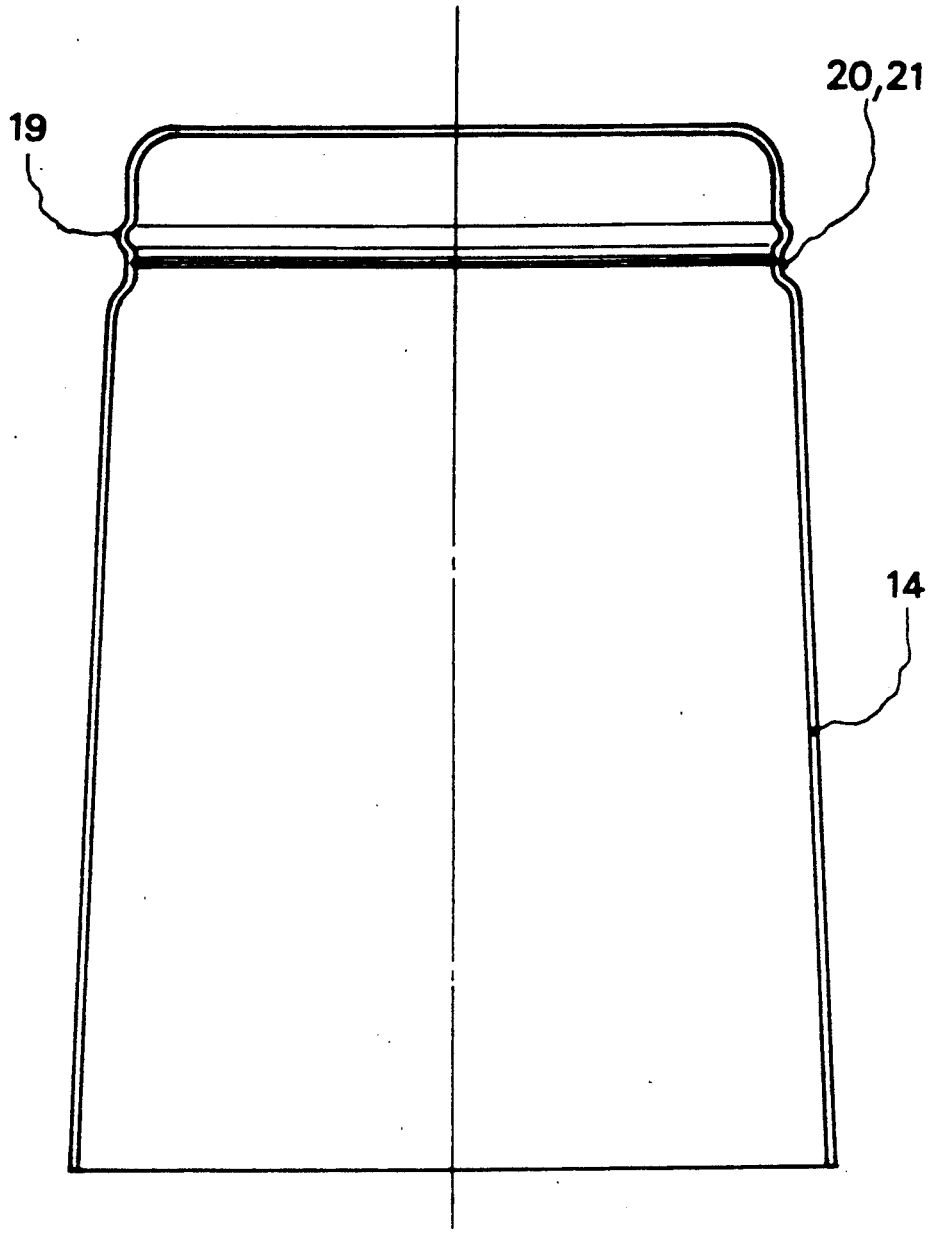
FIG. 1
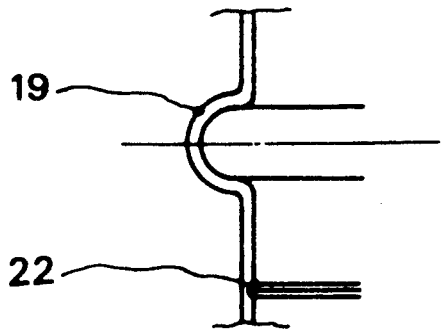
FIG. 1bis

EASILY CUT ALUMINIUM CLOSURE CAPSULE

The present invention relates to closure capsules used typically for capping containers such as wine bottles stoppered with a cork which is inserted completely into the neck, these capsules being capable of being cut in the same way as conventional tin-plated lead closure capsules. The invention also relates to a method of producing them.

The closure capsule conventionally used for wine bottles and in particular for bottles containing top-of-the range wines, is as tin-plated lead capsule obtained by stamping, drawing or by spin-drawing.

This capsule which is crimped onto the neck of a bottle can be removed with a knife by one of the following two techniques:

- cutting along the top connection of the shoulder of the ring of the neck (EUCAPA technology), the shoulder often being referred to as the "glass maker's ring";
- cutting along the edge of the top end of the neck.

In either case, this operation presents no problem due to the fact:

- of the low resistance of tin-plated lead to being cut;
- of the malleability of this metal which does not give rise to any sharp edge.

To meet the problems of protecting the environment and the consumer, seeking to reduce the use of lead, the Applicants sought to perfect a metallic closure capsule which is capable of being cut in the same way as conventional lead-based capsules, that is to say with a knife.

Furthermore, there are easily opened aluminium closure capsules which comprise peripheral tear-off tongues. Such capsules are described in the document FR-B-2 548 114; they do not solve the problem posed.

EXPOSITION OF THE INVENTION

The primary object of the invention is an aluminium or alloy closure capsule comprising a head and a skirt, intended to be crimped onto the neck of a bottle on which the ring has a shoulder, the skirt of the said capsule comprising a peripheral line of weakness situated above the said shoulder on the ring of the neck when the capsule is crimped onto the neck, as is known for example from the document FR-B-2 548 114. According to the invention, so that it can be easily cut with a knife in the same way as a lead based capsule, the skirt of this aluminium capsule also comprises a retaining ring or a peripheral rib which, after the capsule has been crimped onto the neck, will with the portion of the said skirt which covers the top edge of the said shoulder of the neck, define an annular groove permitting guidance of a blade for cutting the capsule, and the line of weakness of the capsule consists of a thinned peripheral zone situated in the bottom of the said groove.

It should be noted that the aluminium or alloy closure capsule is obtained by pronounced shaping operations, particularly successive drawing and rolling operations, and that it should therefore have a minimum skirt thickness of around 0.08 to 0.10 mm. Tests conducted by the Applicants have shown that such a capsule which is annealed and then crimped onto a bottle neck gave rise to latent difficulties in the above-described process of manually cutting the capsule with a knife: the cutting effort is too great and there are risks of the user accidentally cutting himself on the sharp edges left by the cutting process.

The closure capsule according to the invention makes it possible to resolve both these difficulties: cutting of the bottom of the annular groove comprised between the chamfer corresponding to the top of the shoulder of the neck and the peripheral retaining ring is easy thanks to the fact that the bottom of the groove is of a reduced thickness and also because the sides of the annular groove constitute a kind of hollow rail which permits of convenient and sure guidance and sliding of the user's knife blade, the cutting edge of the blade bearing on the thinned zone or in the immediate vicinity of this zone which facilitates the cutting even further, as will be seen hereinafter.

The retaining ring reveals the cutting zone situated as previously just above the top chamfer of the shoulder of the neck, and the cutting blade is, according to previous custom, bearing on the covering of the shoulder, with the addition of a guide means (the rib) which prevents the blade slipping off or having to be held at too oblique an angle. Furthermore, the position of the cutting line or cutting/tearing line in the vicinity of the top chamfer of the shoulder and set back from this chamfer is inaccessible or not readily accessible to the user's fingers, so that the risks of injury on sharply cut edges are virtually eliminated.

The easy cutting zone of the invention is continuous and is broken by cutting and possibly tearing whereas the conventional line of weakness in an aluminium capsule is discontinuous and comprises breakable bridges which are broken by pulling/shearing.

The annular hollow zone forming a guide rail must permit normal knife blades to be introduced, particularly kitchen knives and pocket knives. The bottom of this annular zone or rail, of which the sides form a slightly widened inlet, has a width or "height" according to the longitudinal axis of the capsule which is assumed to be vertical, of between 0.5 and 2.5 mm and preferably between 0.8 and 1.8 mm in order to give a tighter guidance to knife blades normally used for this purpose. Indeed, at about 0.5 to 1.5 mm from their cutting edge, the thickness of these blades is typically comprised between 0.5 and 1 mm.

The thinned peripheral zone of the bottom of the annular groove comprises:

- either a notch or incision in the form of an inner groove leaving a minimum residual skirt thickness of between 0.02 and 0.07 mm and preferably between 0.025 and 0.04 mm to ensure the best compromise between mechanical resistance during crimping and ease of cutting;
- or a continuous inner zone with no groove being formed, leaving a minimum residual skirt thickness of between 0.02 and 0.07 mm over a height on the longitudinal axis of at least 0.4 mm and more often than not limited to less than 1.4 mm (see the example of embodiment).

Tests have shown that in the case of a notch or incision in the form of an inner groove, this facilitates cutting by a knife even if the blade of the knife is offset by 0.5 mm or a little more in relation to the bottom of the groove or incision corresponding to the minimum thickness. With this offset, the knife blade still produces an easy cut by the exterior notch and tearing effect.

The same applies to a thinned zone having a continuous inner surface with no groove of limited height but it is important to note that this type of reduced thickness makes it possible to eliminate any relative cutting difficulty which might be due to a problem of accuracy in centring the knife blade thanks to the choice of a sufficient height of thinning. Thus, if the reference thickness of the knife blade is 1 mm and the height of the annular groove is 1.5 mm, the maximum clearance or axial offset of the blade in the groove will be 0.5 mm and it is sufficient to have a thinned zone centred in the bottom of the groove and of a height which in its axis is at least 0.5 mm in order to eliminate possible irregularities in cutting, the cutting edge of the knife then necessarily being on the thinned portion of the skirt.

As the annular groove is bounded on the side of the capsule head by the peripheral rib or retaining ring, the size of this ring or rib identified by its outside diameter depends on two factors: the quality of guidance of the knife blade and the strength of the external decoration normally applied before the retaining ring is made. It has been found that the outside diameter of this retaining ring ought to be 1 to 3 mm greater than the diameter of the skirt of the capsule on the retaining ring side, and preferably 1 to 2 mm greater than this skirt diameter in order better to preserve the decoration. Then, the retaining ring typically has a height on its longitudinal axis of between 0.5 and 2 mm and more often than not between 0.5 and 1 mm. It has been noted that the absence of a retaining ring or rib resulted in the knife blade frequently slipping.

A second object of the invention is a method of producing the aforementioned aluminium or alloy closure capsule.

In this method, an aluminium or alloy blank has been converted to a closure capsule comprising a head and a skirt, using conventional methods, that is to say flow turning or drawing and ironing. The additional shaping according to the invention, carried out on the capsule which is obtained and which is annealed or which is perhaps is not yet annealed, conventionally decorated, comprises the following operations:

(a) a punch is made up which enters the said capsule, the punch comprising between a bottom position and a top position which fits over the head of the capsule, a portion with a rounded circumference which is at least 0.5 mm in radius greater than the head portion and between this portion of rounded circumference and the bottom portion there is a set-back portion comprising a projecting portion set back by at least 0.25 mm in radius in relation to the said rounded portion;

(b) a roller is prepared which comprises at least one upper portion for supporting the top of the capsule fitted onto the stamp and a portion for shaping and supporting the said capsule in the annular hollow portion of the stamp, the outside diameter of this shaping and supporting portion being chosen so that it comes within 0.02 to 0.07 mm of the proJecting portion of the said set-back portion when the roller is bearing radially against the head portion of the stamp covered with the capsule;

(c) the stamp is covered by the capsule;

(d) the roller is applied against the stamp covered with the capsule, causing them to turn one in relation to the other, the shaping and supporting portion of the roller then bearing on the capsule at right-angles to the set-back portion of the stamp while its upper portion bears against the head of the capsule which fits over the head portion of the stamp;

(e) the roller is moved away from the covered stamp and after rotation has come to a sufficient standstill, the capsule is withdrawn from the stamp.

Shaping of that zone of the closure capsule which is easily cut with a knife is thus obtained by a simple apparatus which performs the process rapidly by shaping successive supporting zones of the capsule on the stamp.

The bottom of the annular groove shaped on the capsule is weakened by a thinning of its thickness between the projecting portion of the stamp and the shaping and roller supporting portion and it has been found that these two types of projecting portion were particularly suitable (profiles in axial section):

V-shaped portions with an end edge of a radius comprised between 0.03 and 0.08 mm;

rounded portions with or without a small central flattened part.

To preserve the covering and easily extract the capsule from the stamp after shaping, it is preferable to limit the amount by which the rounded part of the stamp forming the rib according to the invention projects radially and it has been found that a proJection of 0.5 to 1.2 mm in radius in relation to the head part of the stamp, corresponding to the same amount of projection as the rib formed on the capsule, resulted in a correct extraction of the capsule from the mandrel while providing an effective guidance of the blade for cutting the capsule on the bottle.

The examples and the drawings which illustrate them will make it possible more clearly to understand the invention and to clarify certain points.

TESTS AND EXAMPLES

FIG. 1 shows a closure capsule according to the invention, in cross-section. FIG. 1*b* represents enlarged details of the means for opening this capsule.

FIRST EXAMPLE

Figure 2:
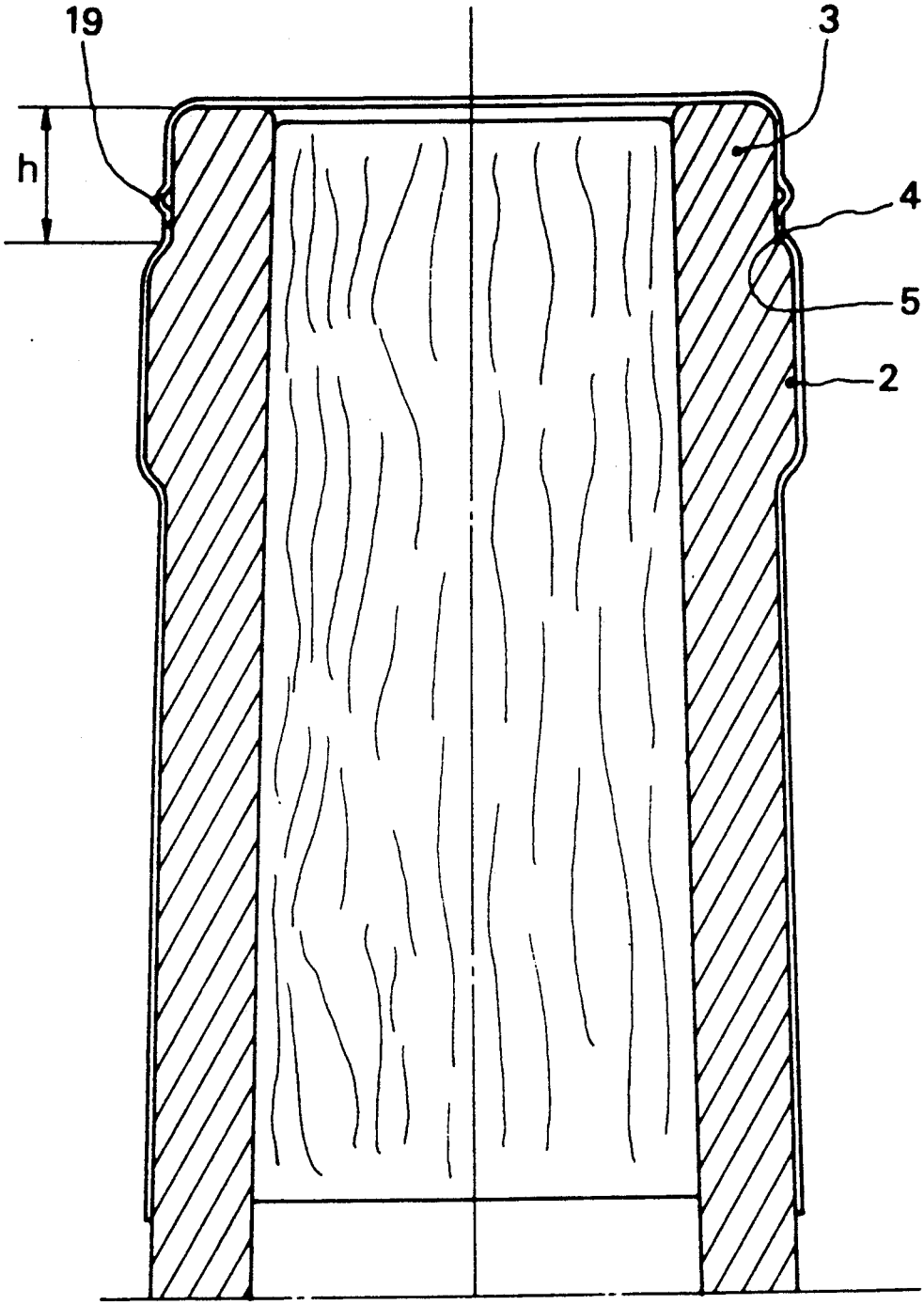
FIG. 2 shows a similar capsule crimped on a bottle, in cross-section.

Aluminium capsules were used obtained by drawing and ironing and then annealed, having an inside diameter at the end (close to the bottom) of 29.5 mm, with a restriction at the head which is 6 mm in height, corresponding to wine bottles 1 having a ring comprising a single shoulder 2 of a total height of 10 mm and above an end portion 3 of a total height of 6 mm (FIG. 2).

These capsules were in the annealed state and their skirts had a thickness of 0.10 mm; they were made cone-shaped for being stacked as a "stick".

Figure 3:
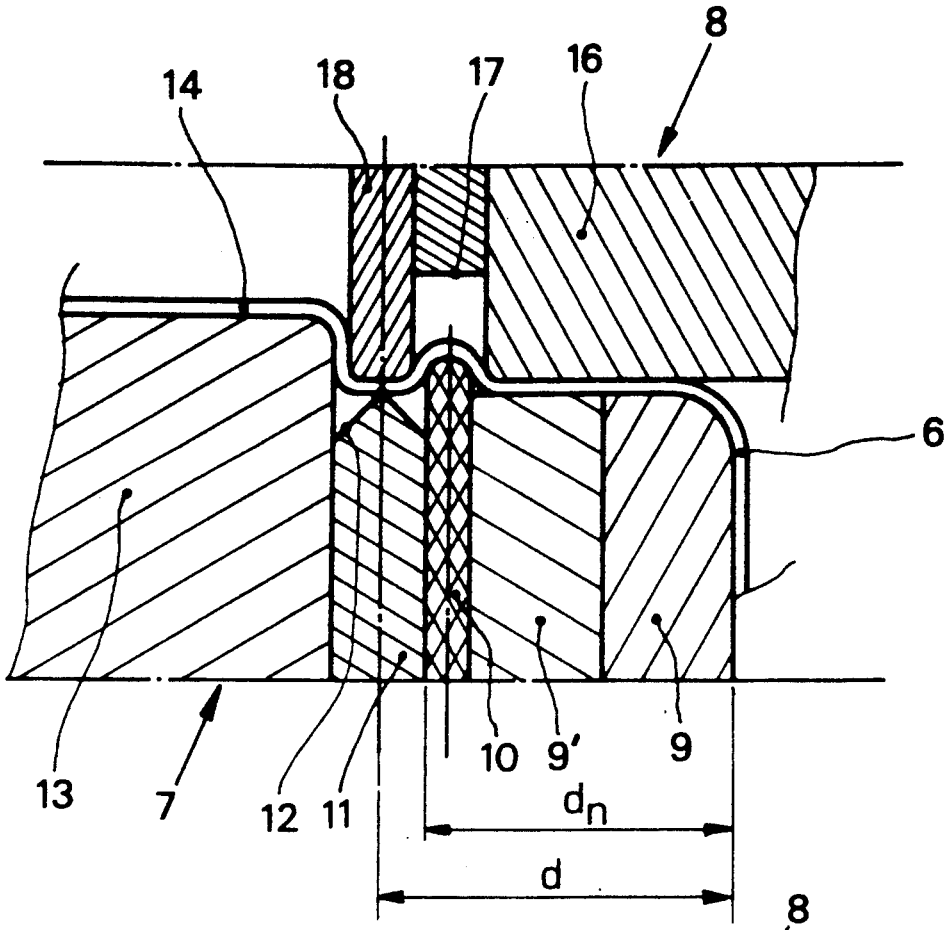
FIG. 3 represents the production tools of the apparatus for easily opening these capsules, in the working position, in a section through the plane passing through the axes of symmetry and rotation of the stamp and of the roller in this apparatus.

A/ 5 of these capsules were crimped on empty bottles (not shown), and an attempt was made to cut them off with a knife blade applied to the chamfer 4 at the base of the capsule head, this chamfer 4 itself bearing on the top edge or top chamfer 5 of the shoulder 2 of the ring of the bottle (same arrangement as in FIG. 2). After fruitless tests, two capsules were successfully cut when a considerable effort was applied to the knife, an effort which is unacceptable in practice;

B/ Additional shaping was carried out on 10 capsules 6 on a device comprising a rotary stamp 7 and a loose roller 8. The stamp 7 (FIG. 3) comprises stacked rings making it possible easily to adapt to the type of capsule; viz., starting from the top: head rings 9 and 9' of a diameter of 26.03 mm and a total height of 4 mm, a flat ring 10 of a height on its axis of 0.6 mm and with a rounded peripheral surface of a radius of 0.3 mm in cross-section and an outside diameter of 27.2 mm, and then a ring 11 of a height of 1.4 mm comprising in cross-section an end profile 12 which is V-shaped to an angle of 90° with an end radius or edge of 0.05 mm with an outside diameter of 26.16 mm and then a portion 13 carrying the skirt 14 of the capsule 7 in its successive supporting zones on the mandrel 7 and retaining correct engagement of this capsule 6 on the bottle at the time of crimping.

The roller 8 which has just been applied against the top of the capsule 6 in this case comprises a top supporting portion 16 of a diameter 40, and then a groove 17 of a depth of 2 mm and of a width of 1 mm and then a ring 18 with a height of 1 mm and a diameter of 40 mm. Each capsule 6 is placed on the stamp 7 and, while this stamp is caused to rotate, the roller 8 is brought close until its top portion 16 is bearing against the head of the capsule 6 which is itself locked on the head 9 and 9' of the stamp 7. In this position, the groove 17 in the roller is centred on the rounded portion 10 of the stamp while its ring 18 crushes the skirt 14 of the capsule 6 against the V-shaped periphery of the ring 11. It remains in this position for one or several rotations and then the roller and the capsule are released.

Examination of the capsules 6 after removal (FIGS. 1 and 1*b*) shows the following changes: Shaping of a circular relief retaining ring 19 with an outside diameter of 29.5 mm and a height of 1 mm and an annular groove 20 comprised between the retaining ring 19 and the chamfer 4 at the bottom of the head of the capsule 6. The bottom 21 of this groove 20 has a diameter of 28.3 mm and a height of 0.8 mm. On the inside (opening of 2 capsules), this bottom 21 comprises an interior V-shaped groove 22 and its residual thickness at the bottom of this groove is 0.035 mm, which corresponds to half the difference $(26.03+2\times0.1-26.16)$ mm.

Figure 4:
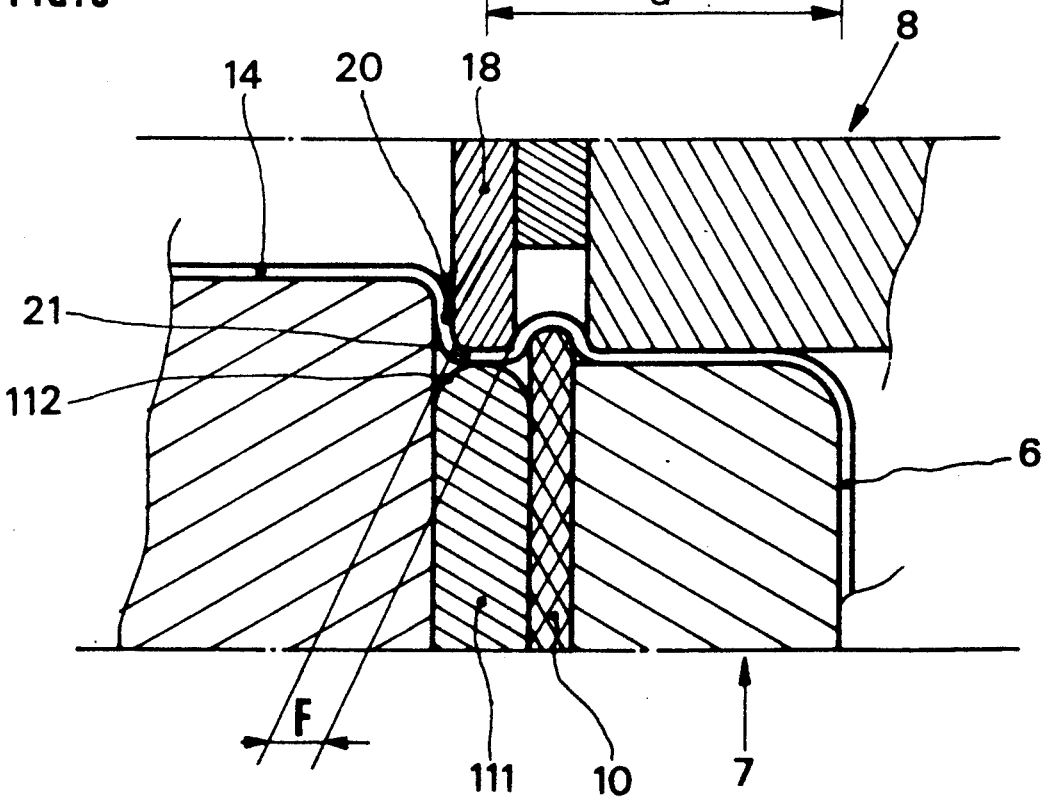
FIG. 4 shows an alternative form of these tools, the projecting part of the stamp having a rounded profile.

The 8 capsules not opened for interior examination were crimped onto bottles using a socket protecting the easy-cut profiled zone which is thus produced on each capsule. Cutting of the closure capsules thus crimped on, using a knife, produced a clean separation of the head of the capsule when moderate pressure was applied to the knife blade. It will be noticed that here and generally the gap "d" between the top end of the stamp 7 and the median plane of the set-back portion 11 or 111 defines the average distance from the thinned peripheral zone of the capsule 6 to the end of the neck of the bottle 1 on which it is crimped. The distance "d" between the end of the stamp 7 and the bottom surface of the rounded edge portion 10 which is the plane of junction of this portion 10 and of the set-back portion 11 or 111 regulates the position of the bottom edge of the peripheral rib 19 and the bottom 21 of the annular zone 20 of the capsule crimped in has a width or height in its longitudinal axis which is equal to or slightly less than (in practice by at most 0.5 mm) to:

$$F=h-d_N-2\times e \text{ (mm)}$$

in which h is the height of the end portion of the neck of the bottle beyond its shoulder (FIG. 2) and e is the thickness of the skirt 14 of the capsule 6. Here $h=6$ mm; $d_N=4.6$ mm, and $e=0.1$ mm so that the height F of the bottom 21 of the annular groove 20 is 1.2 mm. This height is already regulated during the additional shaping stage, the height of the mandrel 7 above the bottom portion 13 being 6 mm and crimping having to perform only at this level a deformation of the bottom edge 4 of the annular groove 20 into a truncated cone over the top chamfer 5 of the shoulder 2 (FIG. 2), without any substantial change in the height of the bottom 21 of this groove 20. The position of the bottom edge 4 of the groove 20 being thus finalised, the height F of the bottom 21 is therefore virtually equal to the height of the shaping portion 18 of the roller 8 (FIG. 4).

Generally speaking, the position of the bottom edge 4 after additional shaping may be offset upwardly by a few tenths of a millimetre, typically less than 0.5 mm and then the height of the bottom of the annular groove is slightly increased by crimping of the capsule onto the neck of the bottle. Adjustment of the annular groove by the choice of its calculated height F between 0.5 and 2.5 mm and preferably between 0.8 and 1.8 mm makes it possible to regulate the resultant height after crimping.

SECOND EMBODIMENT

Using the same stamped-drawn capsules and after having replaced the ring 10 of the stamp by a ring of a diameter of 27.2 mm, capsules were produced comprising the interior notch according to the invention but not the guide rib 19 associated therewith: the user's knife which is used to remove the cap in order to open the wine bottle easily slips and such a solution is not advocated. The rib or ring 19 is required to obtain easy cutting with no risk of the user accidentally being hurt.

THIRD EMBODIMENT

10 capsules 6 from the series already supplied were taken and additional shaping was performed on these capsules identical to that in the first example, with the exception of the following change: The ring 11 of the stamp 7 (FIG. 3) was replaced by a ring 111 of the same height 1.4 mm and with a rounded peripheral surface 112 of an outside diameter of 26.26 mm (FIG. 4). As FIG. 4 shows, the work of shaping the skirt 14 between the periphery of the ring 18 of the roller 8 and the rounded periphery 112 of the ring 111 of the stamp 7 causes the skirt 14 to be crushed as the result of its being placed under traction, the resultant thinning being produced by the two processes. After this shaping, the thickness at the middle of the bottom of the annular groove 22 is $(26.03+2\times0.1-26.16)\times0.5=0.035$ mm as previously, and it can be seen that the residual thickness of the bottom 21 is less than 0.05 mm over at least 0.8 mm of height. After crimping on bottles, these capsules were readily cut with a knife, as previously.

USE AND ADVANTAGES

The capsules and the method according to the invention are used for any case where the capsule is to be removed from the bottle by means of a knife. Generally, the thickness of the capsules is between 0.08 and 0.3 mm and they are of slightly alloyed aluminium, typically comprising more than 97% Al.

Above and beyond the ease with which they accept additional shaping and then being cut with a knife in the conventional place, it should be noted that these capsules are not based on lead (this is of ecological interest.)

I claim:

1. A closure capsule formed of aluminum or aluminum alloy and having a container contacting inner surface and an outer surface, said capsule comprising a head portion and an integral skirt portion, said head portion including an annular radially projecting rib, said skirt portion including an annular radially projecting shoulder portion adapted to rest juxtaposed an annular radially projecting ring of a neck of a container, said annular radially outwardly projecting rib of said head portion and said annular radially outwardly projecting shoulder portion defining therebetween a generally imperforate cutting zone for guidance of a knife blade or the like for severing said head portion from said skirt portion, said cutting zone provided with an annular weakened zone formed in said container contacting inner surface for facilitating severing of head and skirt, said capsule being adapted to be crimped onto the container in overlying relation to the access area of the container with said shoulder portion juxtaposed the annular radially outwardly projecting ring.

2. A capsule according to claim 1 in which the cutting zone has a longitudinal axial height comprised between about 0.5 and about 2.5 mm.

3. A capsule according to any one of claims 1 or 2 in which the annular weakened zone of the bottom of the cutting zone comprises a notch or incision in the form of an interior groove leaving a minimum residual thickness of skirt of between about 0.02 and about 0.07 mm.

4. A capsule according to claim 3, the minimum residual thickness of skirt being between about 0.025 and about 0.04 mm.

5. A capsule according to any one of claims 1 or 2 in which the annular weakened zone of the bottom of the cutting zone comprises a continuous interior surface with no formation of groove, leaving a minimum residual thickness of skirt of between about 0.02 and about 0.07 mm over a longitudinal axial height of at least about 0.4 mm.

6. A capsule according to claim 3, wherein the annular rib has an outside radially projecting diameter which is 1 to 3 mm greater than the diameter of the skirt on the same side as the retaining ring or rib.

7. A closure capsule formed of aluminum or aluminum alloy and having a container contacting inner surface and an outer surface, said capsule comprising a head portion and an integral skirt portion, said head portion including an annular radially projecting rib, said skirt portion forming, when the capsule is crimped onto a neck of the container, an annular radially projecting shoulder portion resting juxtaposed an annular radially projecting ring of said neck, said annular radially outwardly projecting rib of said head portion and said annular radially outwardly projecting shoulder portion defining therebetween a generally imperforate cutting zone for guidance of a knife blade or the like for severing said head portion from said skirt portion, said cutting zone provided with an annular weakened zone formed in said container contacting inner surface for facilitating severing of head and skirt, said capsule being adapted to be crimped onto the container in overlying relation to the access area of the container with said shoulder portion juxtaposed the annular radially outwardly projecting ring.

* * * * *